US005636793A

United States Patent [19]

Gurevitch

[11] Patent Number: 5,636,793

[45] Date of Patent: Jun. 10, 1997

[54] ROTARY SPRINKLER AND METHOD OF DISTRIBUTING WATER AROUND A ROTARY SPRINKLER

[75] Inventor: Yossef Gurevitch, Doar Gvat, Israel

[73] Assignee: Plastro Gvat, Doar Gvat, Israel

[21] Appl. No.: 506,489

[22] Filed: Jul. 25, 1995

[51] Int. Cl.[6] ..... B05B 3/06

[52] U.S. Cl. ..... 239/256

[58] Field of Search ..... 239/251, 253, 239/256–258, 262

[56] References Cited

U.S. PATENT DOCUMENTS

| | | | |
|---|---|---|---|
| 724,350 | 3/1903 | Stauff | 239/258 |
| 1,239,229 | 9/1917 | Shaw | 239/256 X |
| 2,598,316 | 4/1952 | Johnson | 239/256 X |
| 2,991,942 | 7/1961 | Rosenkranz | 239/258 X |
| 2,998,197 | 8/1961 | Kachergis | 239/258 |
| 3,357,644 | 12/1967 | Penfield et al. . | |
| 3,744,721 | 7/1973 | Baumstark | 239/253 X |
| 4,198,001 | 4/1980 | Rodriguez . | |
| 4,272,018 | 6/1981 | Hickson . | |
| 4,474,328 | 10/1984 | Hale . | |
| 4,596,362 | 6/1986 | Pralle et al. . | |
| 4,715,538 | 12/1987 | Linngau | 239/251 X |
| 4,768,709 | 9/1988 | Yie . | |
| 5,009,368 | 4/1991 | Streck et al. . | |
| 5,039,013 | 8/1991 | Sawade et al. . | |
| 5,248,095 | 9/1993 | Rankin et al. . | |

FOREIGN PATENT DOCUMENTS

| | | | |
|---|---|---|---|
| 314177 | 6/1929 | United Kingdom | 239/258 |

*Primary Examiner*—Kevin Weldon
*Attorney, Agent, or Firm*—Benjamin J. Barish

[57] ABSTRACT

A rotary sprinkler and method of distributing water by providing two discharge nozzles on a rotor for discharging water outwardly of the sprinkler along axes extending preselected adjustable distances laterally of the rotary axis to provide moments tending to rotate the sprinkler in opposite directions, to enable the rotational speed and rotational direction of the rotor to be adjusted.

18 Claims, 2 Drawing Sheets

FIG. 1
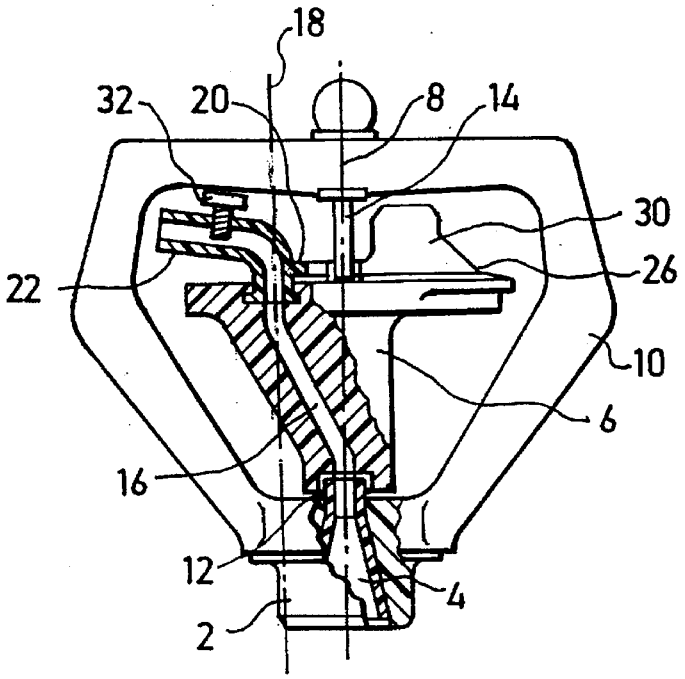
FIG. 2
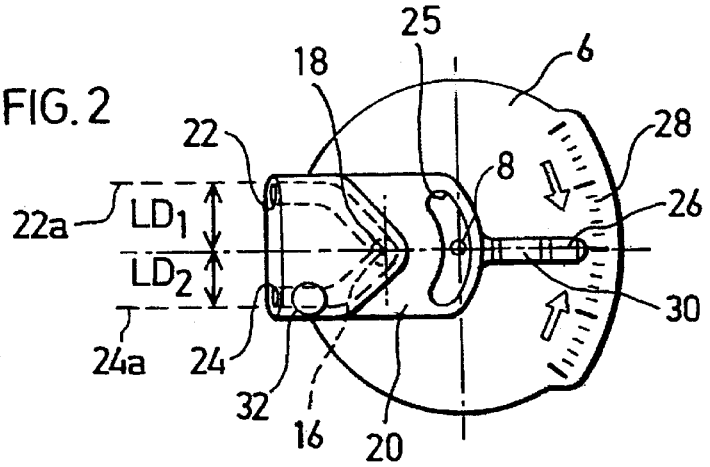
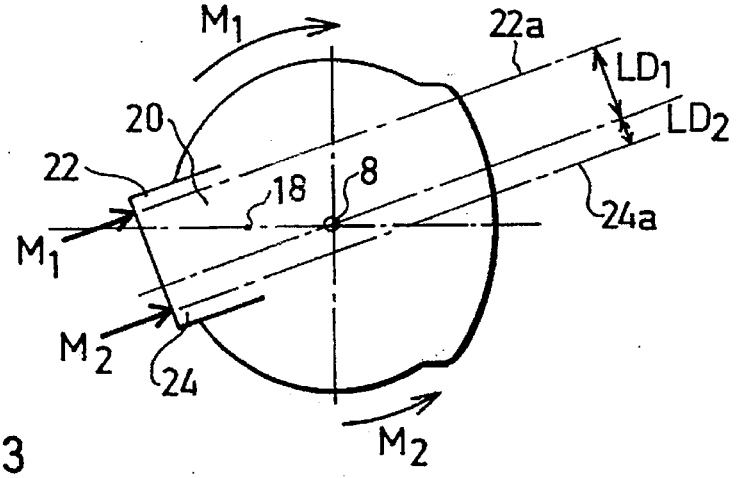
FIG. 3

FIG. 4
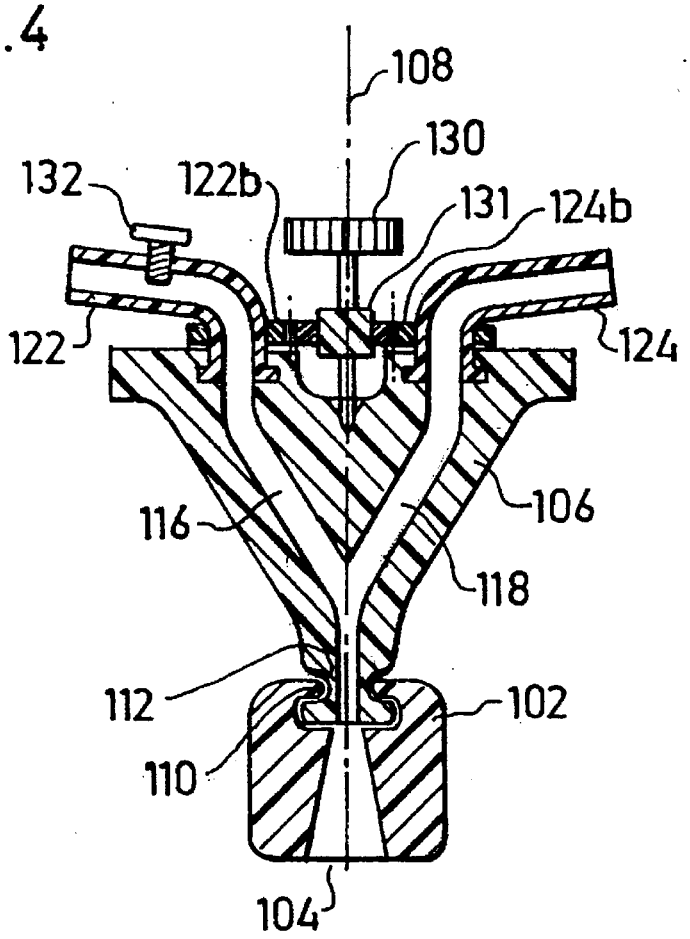
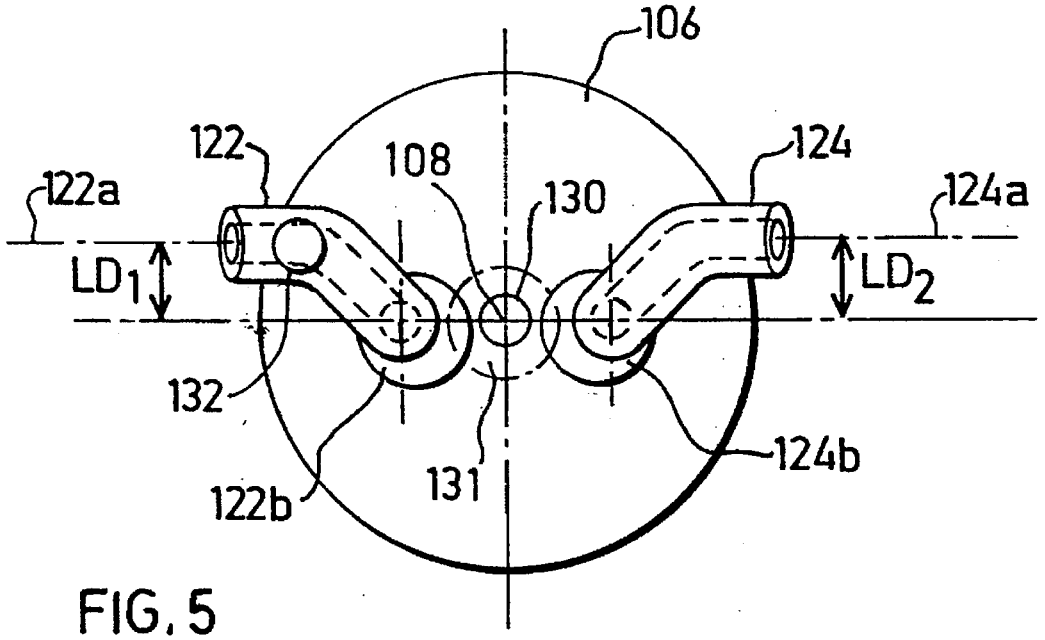
FIG. 5

ROTARY SPRINKLER AND METHOD OF DISTRIBUTING WATER AROUND A ROTARY SPRINKLER

FIELD AND BACKGROUND OF THE INVENTION

The present invention relates to rotary sprinklers, and particularly to a rotary sprinkler of a construction which enables its rotational speed to be conveniently controlled. The invention also relates to a method of distributing water around a rotary sprinkler.

Various techniques have been developed for controlling the rotational speed of a rotary sprinkler. One common technique is to use a speed-reduction gearing, but such constructions are relatively expensive to produce and also to maintain. Another technique is to use a friction-type retarding device or a viscous-liquid type retarding device, but these techniques waste a significant part of the energy in the pressurized water supply, dissipating this energy as heat. The foregoing types of rotary sprinklers are also sensitive to pressure variations in the supply line.

OBJECTS AND BRIEF SUMMARY OF THE INVENTION

An object of the present invention is to provide a rotary sprinkler having a novel construction for conveniently adjusting the rotary speed of the sprinkler. Another object of the invention is to provide a method of distributing water around a rotary sprinkler in a manner permitting convenient adjustment of the rotational speed of the sprinkler.

According to one aspect of the present invention, there is provided a rotary sprinkler comprising: a housing connectible to a pressurized water supply; a rotor rotatably mounted to the housing about a rotary axis; a first discharge nozzle carried by the rotor for discharging water outwardly of the sprinkler at a first discharge rate along a discharge axis extending a first distance laterally of the rotary axis to produce a moment tending to rotate the sprinkler in one direction; a second discharge nozzle carried by the rotor for discharging water outwardly of the sprinkler at a second discharge rate along a discharge axis extending a second distance laterally of the rotary axis, on the opposite side from the first discharge axis, to produce a moment tending to rotate the sprinkler in the opposite direction, whereby the rotational speed and rotational direction of the rotor is dependent upon the moments produced by the two discharge nozzles and adjusting means for changing at least one of said lateral distances in order to adjust the rotational speed of the rotor.

According to further features in the described preferred embodiment, the rotary sprinkler further includes changing means for adjusting at least one of the distances or discharge rates for adjusting the rotational speed of the rotor.

Since the moment produced by the discharge of water from each of the discharge nozzles is a function of the product of the lateral distance of the respective discharge axis from the rotary axis and the respective discharge rate, it will be seen that not only the rotational speed of the rotor, but also the rotational direction of the rotor, may be conveniently adjusted by adjusting one for both of the lateral distances and/or one or both of the discharge rates. Moreover, such a sprinkler is less sensitive to variations in the line pressure since the line pressure affects both moments in substantially the same manner.

According to further features in one preferred embodiment of the invention described below for purposes of example, the adjusting means comprises a common carrier member carrying both discharge nozzles and pivotally mounted to the rotor about a pivotal axis coaxial with the rotary axis of the rotor. In this described preferred embodiment, both discharge nozzles are on the same side of the carrier member; the opposite side of the carrier member includes a pointer cooperable with markings on the rotor indicating various speeds of the rotor for different pivotal positions of the carrier member.

According to a second described embodiment, the adjusting means comprises a separate pivotal mounting for each of the discharge nozzles, and an adjusting member coupled to both pivotal mountings to adjust them together.

As an optional feature to one or both described embodiments, the adjusting means may also include an adjustable member, such as a threaded pin, for adjusting the effective size of one or both of the discharge nozzles in order to adjust the respective discharge rate.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a side elevational view, partly in section, illustrating one form of rotary sprinkler constructed in accordance with the present invention;

FIG. 2 is a top plan view of the rotor in the sprinkler of FIG. 1;

FIG. 3 diagrammatically illustrates how the rotational speed of the sprinkler of FIGS. 1 and 2 may be adjusted;

FIG. 4 is a sectional view illustrating another form of rotary sprinkler constructed in accordance with the present invention;

and FIG. 5 is a top plan view of the sprinkler of FIG. 4.

DESCRIPTION OF PREFERRED EMBODIMENTS

The sprinkler of FIGS. 1—3 includes a housing 2 having an inlet 4 connectible to a pressurized water supply, and a rotor 6 rotatably mounted to the housing about a rotary axis 8 for distributing the water laterally of the sprinkler. In this case, the rotor 6 is rotatably mounted to a bridge 10 integrally formed with, or fixed to, the sprinkler housing 2. Thus, rotor 6 is rotatably mounted between a vertically-extending nozzle 12 of housing 2, and a pin 14 depending from the bridge 10. Both nozzle 12 and pin 14 are coaxial with the rotary axis 8 of the rotor 6.

Rotor 6 is formed with a passageway 16 extending through it to a carrier member 20 pivotally mounted to rotor 6 about a pivotal axis which is laterally of the rotary axis 18 of the rotor. Carrier member 20 carries a pair of discharge nozzles 22, 24, both communicating with the upper end of passageway 16, to discharge the water laterally outwardly of the sprinkler. As seen particularly in FIG. 2, the two discharge nozzles 22, 24, are on one side of pivotal mounting 18 of carrier member 20; the opposite side of the carrier member is formed with a curved slot 25 recieving pin 14, and a pointer 26 which is cooperable with graduation markings 28 formed on the upper surface of rotor 6.

As also seen in FIG. 2, discharge nozzle 22 discharges the water outwardly of the sprinkler along the discharge axis 22*a* which extends laterally of the rotary axis 8 of the rotor by the lateral distance $LD_1$; similarly, discharge nozzle 24 discharges water outwardly of the sprinkler along the discharge axis 24*a* which extends laterally, and on the opposite side, of the rotary axis 8 by the lateral distance $LD_2$.

If the water discharge rates of the two discharge nozzles 22, 24 are equal, it will be seen that the rotational moment produced by the discharged water from each nozzle will depend on the lateral distance of the respective discharge axis from the rotary axis 8. In the condition illustrated in FIG. 2, these lateral distances ($LD_1$, $LD_2$) are approximately equal, so that there will be no, or very little, rotation of the rotor 6 when the discharge rates are the same in the two discharge nozzles 22, 24.

Carrier member 20 may be pivotted about axis 18 in order to select the rotational speed, as well as the rotational direction, of the rotor 6. Carrier member 20 is provided with a fingerpiece 30 projecting outwardly from its pointer 26 to facilitate rotation of the carrier member. Thus, if the carrier member is rotated counterclockwise, to the position illustrated in FIG. 3, it will be seen that lateral distance $LD_1$ is increased, whereas the later distance $LD_2$ is decreased. The turning moment $M_1$ produced by the discharge of water via outlet 22 will therefore be greater than the turning moment $M_2$ produced by the discharge of water via outlet 24. As a result, the rotor will rotate clockwise at a speed corresponding to $LD_1$–$LD_2$.

In order to increase the rotational speed in the same direction, carrier member 20 would be rotated further counterclockwise to further increase $LD_1$ and to further decrease $LD_2$; and in order to decrease the rotational speed of the rotor or to rotate the rotor in the opposite direction, carrier member 6 would be rotated clockwise in the opposite direction from that illustrated in FIG. 3.

Pointer 26 and graduation markings 28 will indicate the rotational speed, and also the rotational direction, of the rotor 6 as determined by the preset position of the carrier member 20.

Rotational speed control may also be effected by adjusting the discharge rate from one or both of the discharge nozzles 22, 24. For this purpose, FIG. 2 illustrates discharge nozzle 24 as receiving a threaded pin 32, which may be threaded more or less with respect to the discharge nozzle 24 to adjust the effective size of the nozzle.

The rotary sprinkler illustrated in FIGS. 4 and 5 is of somewhat a different construction but operates on the same principle as in FIGS. 1–3. This sprinkler also includes a housing 102 having an inlet 104 connectible to a pressurized water supply, and a rotor 106 rotatably mounted to the housing about a rotary axis 108. In this case, however, the rotor 106 is mounted to the housing 102 by an annular rib 110 formed in the upper end of housing 102 received within an annular recess 112 formed in the lower end of the rotor 106.

The rotary sprinkler illustrated in FIGS. 4 and 5 also supplies water, via paths 116, 118, to two discharge nozzles, 122 and 124, located to discharge the water along discharge axes 122*a*, 124*a* which are laterally of the rotary axis 108 of the rotor 106. In this case, however, the two discharge nozzles 122, 124 are carried by separate pivotal mounting members in the form of gears 122*b*, 124*b*, respectively, such that pivotting them will change the respective lateral distance $LD_1$, $LD_2$ of their discharge axes 122*a*, 124*a*, with respect to the rotary axis 108 of the rotor. For example, rotating discharge nozzle 122 counterclockwise will increase its lateral distance $LD_1$, whereas rotating discharge nozzle 124 counterclockwise will decrease its lateral distance $LD_2$. Both lateral distances may be changed simultaneously by a fingerpiece 130 rotating a gear 131 meshing with both gears 122*a* and 124*b*.

It will thus be seen that the rotational speed, as well as the rotational direction, of the rotor in the sprinkler illustrated in FIGS. 4 and 5 may be adjusted in the same manner as described above with respect to FIGS. 1–3 by rotating fingerpiece 130.

As also described in FIGS. 1–3, the rotational speed may be adjusted by adjusting the flow rate through one or both of the discharge nozzles 122, 124. For this purpose, discharge nozzle 122 receives a threaded pin 132, corresponding to pin 32 in FIG. 2, for varying the effective size of nozzle 122.

While the invention has been described with respect to two preferred embodiments, it will be appreciated that many variations may be made. For example, the sprinkler could be constructed with preset lateral distances between the two discharge nozzles, to provide a predetermined rotational speed and rotational direction. Also, only one of the discharge nozzles could be adjustable, the other being fixed. In most cases where the rotational speed is to be preset according to the lateral distances of the two discharge nozzles, adjustment of the discharge rate of one or both discharge nozzles would not be necessary. Many other variations, modifications and applications of the invention will be apparent.

We claim:

1. A rotary sprinkler, comprising: a housing connectible to a pressurized water supply; a rotor rotatably-mounted to said housing about a rotary axis; a first discharge nozzle carried by said rotor for discharging water outwardly of the sprinkler at a first discharge rate along a discharge axis extending a first distance laterally of the rotary axis to produce a moment tending to rotate the sprinkler in one direction; a second discharge nozzle carried by said rotor for discharging water outwardly of the sprinkler at a second discharge rate along a discharge axis extending a second distance laterally of the rotary axis, on the opposite side from said first discharge axis, to produce a moment tending to rotate the sprinkler in the opposite direction, whereby the rotational speed and rotational direction of said rotor are dependent upon the moments produced by the two discharge nozzles; and adjusting means for changing at least one of said lateral distances in order to adjust the rotational speed of the rotor.

2. The sprinkler according to claim 1, wherein said adjusting means adjusts both of said lateral distances at the same time.

3. The sprinkler according to claim 2, wherein said adjusting means comprises a common carrier member carrying both said discharge nozzles.

4. The sprinker according to claim 3, wherein said common carrier member is pivotally mounted to said rotor about a pivotal axis coaxial with said rotary axis of the rotor.

5. The sprinkler according to claim 6, wherein both of said discharge nozzles are on the same side of said carrier member, the opposite side of said carrier member including a pointer cooperable with markings on the rotor indicating various speeds of the rotor for different pivotal positions of the carrier member.

6. The sprinkler according to claim 5, wherein said carrier member further includes a finger grip for facilitating pivotting the carrier member about its pivotal axis.

7. The sprinkler according to claim 1, wherein said adjusting means comprises a separate pivotal mounting for each of said discharge nozzles.

8. The sprinkler according to claim 7, wherein said adjusting means further comprises an adjusting member coupled to both of said pivotal mountings to adjust them together.

9. The sprinkler according to claim 8, wherein said adjusting member comprises a gear wheel coupled to a gear wheel on each of said discharge nozzle pivotal mountings.

10. The sprinkler according to claim 1, wherein said adjusting means includes flow rate adjusting means for adjusting at least one of said discharge rates.

11. The sprinkler according to claim 10, wherein said flow rate adjusting means comprises an adjusting member for adjusting the effective size of the respective discharge nozzle.

12. The sprinkler according to claim 1, wherein said rotor is rotatably mounted to said housing by a bridge straddling the rotor.

13. The sprinkler according to claim 1, wherein said rotor is rotatably mounted to said housing by an annular recess receiving an annular rib, one formed in a lower end of the rotor and the other formed in an upper end of the housing.

14. A method of distributing water around a sprinkler having a rotor rotatable about a rotatable axis, comprising: discharging water outwardly of the sprinkler at a first discharge rate along a discharge axis extending a first distance laterally of the rotary axis to produce a moment tending to rotate the sprinkler in one direction; discharging water outwardly of the sprinkler at a second discharge rate along a discharge axis extending a second distance laterally of the rotary axis, on the opposite side thereof from said first discharge axis, to produce a moment tending to rotate the sprinkler in the opposite direction, whereby the rotational speed and rotational direction of the rotor is dependend upon the moments produced by the two discharge nozzles; and changing at least one of said lateral distances to adjust the rotational speed of the rotor.

15. The method according to claim 14, wherein at least one of said discharge rates is also changes for adjusting the rotational speed of the rotor.

16. A method of distributing water around a sprinkler having a rotor rotatable about a rotatable axis, comprising: discharging water outwardly of the sprinkler along a discharge axis extending laterally of the rotary axis to produce a moment tending to rotate the sprinkler about its rotary axis; and adjusting the lateral distance between said discharge axis and said rotary axis to adjust the moment, and thereby the speed of rotation, of the rotor about said rotary axis.

17. The method according to claim 16, including the further step of discharging water outwardly of the sprinkler along a second discharge axis extending laterally of the rotary axis on the opposite side thereof from the first-mentioned discharge axis to produce a moment tending to oppose the moment produced by discharging the water along the first discharge axis; and adjusting at least one of said lateral distances to adjust the speed of rotation of the rotor.

18. The method according to claim 16, wherein the discharge rate of the water is also adjusted to adjust the speed of rotation of the sprinkler.

* * * * *